US005168263A

United States Patent [19]

Drucker

[11] Patent Number: 5,168,263

[45] Date of Patent: Dec. 1, 1992

[54] EAS TAG WITH PIEZOELECTRIC FACILITY FOR MOTION DETECTION

[75] Inventor: Frank Drucker, Tamarac, Fla.

[73] Assignee: Sensormatic Electronics Corporation, Deerfield Beach, Fla.

[21] Appl. No.: 592,362

[22] Filed: Oct. 3, 1990

[51] Int. Cl.[5] ..... G08B 13/14; H01H 35/02

[52] U.S. Cl. ..... 340/571; 200/61.45 R; 340/384 E; 340/572; 340/693

[58] Field of Search ..... 340/571-572, 340/693, 566, 689, 669, 384 E; 310/321-325; 200/61.45 R, DIG. 29

[56] References Cited

U.S. PATENT DOCUMENTS 4,686,513 8/1987 Farrar et al. ..... 340/572
4,758,824 7/1988 Young ..... 340/566
5,025,246 6/1991 Schenkel ..... 340/572

*Primary Examiner*—Jin F. Ng

*Assistant Examiner*—Thomas J. Mullen, Jr.

*Attorney, Agent, or Firm*—Robin, Blecker, Daley & Driscoll

[57] ABSTRACT

An electronic article surveillance tag comprises an electrical power source, receiver circuitry for receiving coded messages for diverse state dispositions of the tag, decoder circuitry for decoding received coded messages and for directing the tag into active and inactive states, alarm circuitry for providing audible output indication of unauthorized activity in respect of the tag in an active state thereof, and motion detector circuitry operative upon disposition of the tag in an inactive state for lessening drain on the electrical power source and further operative on detecting movement of the tag when in the inactive state to dispose the tag in an active state with increased drain on the electrical power source. The alarm circuitry and the motion detector circuitry share common electrical circuit elements, inclusive of a piezoelectric unit.

15 Claims, 4 Drawing Sheets

EAS TAG WITH PIEZOELECTRIC FACILITY FOR MOTION DETECTION

FIELD OF THE INVENTION

This invention relates generally to electronic article surveillance (EAS) systems and practices and pertains more particularly to improved EAS tags of the so-called "active" type, i.e., involving self-powering, such as by a contained battery.

BACKGROUND OF THE INVENTION

Whereas EAS tags are typically of a "passive" type, i.e., do not carry therewith a source of power, but rather respond to incident energy to reradiate the same or a permutation thereof, there are known EAS tags which are of "active" type, carrying therewith a battery or like source of electrical power. Advantage attends the on-board, self-powering capacity, since the tag can thereby be of the so-called "smart" or "intelligent" variety, such as is disclosed in commonly-assigned U.S. Pat. No. 4,686,513, which is incorporated herein by this reference thereto.

The tag of the '513 patent, by reason of its on-board power supply, has capacity for processing coded, received messages to assume responsive diverse states and to exhibit different operational characteristics corresponding with such states, thereby expanding the operational states of the tag as contrasted with the passive-type tags.

One concern attending active tags is that of power source conservation and measures are known to address this concern. A version of commercial tag of the common assignee, Sensormatic Electronics Corporation, included, as a part of the printed circuit board (PCB), which incorporates circuitry related to received message decoding and tag state assignment, electrically conductive traces adapted to be interconnected by movement of an electrically conductive member upon tag orientation change. Thus, one of the states of the '513 patent tag is "Sleep", wherein its circuitry is dormant, conserving battery life. On movement of the article to which the tag is attached, the intention of the commercial tag under discussion was to "re-awaken" on interconnection of the electrical traces by movement of the electrically conductive member. To the extent that movement of the tag did not insure certainty of such trace interconnections, this prior art arrangement was not as effective as desired in preserving power source integrity while at the same time re-awakening tags, i.e., rendering the tag electrical circuitry active.

In commonly-assigned and copending application Ser. No. 507,655, entitled "EAS Tag with Motion Detection Facility" and filed on Apr. 10, 1990, which has issued as U.S. Pat. No. 5,025,246 Jun. 18, 1991, an EAS tag of improved character is disclosed. In that application, there is provided:

(a) an EAS tag inclusive of an electrical power source contained with the tag and circuitry powered by the electrical power source; and (b) a motion sensor operatively associated with the tag and contained therewith, the motion sensor providing output indication of movement and thereupon effecting loading of the electrical power source by such tag circuitry.

The motion sensor comprises first and second housings of electrically conductive material, first and second electrically conductive elements movably supported respectively in the first and second housings, and a joinder member for mechanical interconnection of the first and second housings, the joinder member being comprised of electrically insulative material to electrically isolate the housings from one another and defining a passage permitting movement of the first and second electrically conductive means between the first and second housings responsively to orientation of the sensor or apparatus carrying the same.

The joinder member, the housings and the first and second electrically conductive elements are collectively dimensioned to provide for electrical conductivity between the first and second housings upon reorientation of the tag from a disposition wherein neither of the first and second electrically conductive elements is in registry with the joinder member to other disposition.

While the first-noted and commonly-assigned approach has disadvantages as above noted, the second-noted and commonly-assigned approach is effective in its certainty of detection of tag movement, but has some disadvantage in its cost and complexity. From applicant's viewpoint, need for improvement exists both in lessening cost and in simplifying structure and is herein addressed.

SUMMARY OF THE INVENTION

The present invention has as its primary object the provision of further improved EAS tags of the active type.

It is a more particular object of the invention to provide for enhanced battery life conservation protection in EAS tags of the active type and enhanced re-awakening capability at lessened cost and complexity.

In attaining the foregoing and other objects, the invention provides, in combination, in an electrical apparatus:

(a) an electrical power source and circuitry powered by the electrical power source;

(b) a motion detector comprising piezoelectric means adapted on detecting movement of the apparatus for effecting electrical loading of the electrical power source by the apparatus circuitry; and (c) alarm means for generating audible output, the alarm means and the motion detector sharing common electrical circuitry.

More particularly, the invention provides, in an electronic article surveillance tag of the type comprising an electrical power source, a receiver for receiving coded messages for diverse state dispositions of the tag, a decoder for decoding received coded messages and for directing the tag into active and inactive states, an alarm unit for providing audible output indication of unauthorized activity in respect of the tag in an active state thereof, and a motion detector operative upon disposition of the tag in an inactive state for lessening drain on the electrical power source and further operative on movement of the tag when in the inactive state to dispose the tag in an active state with increased drain on the electrical power source, the improvement wherein the alarm unit and the motion detector are constituted of common electrical circuit elements.

In the particularly preferred embodiment, the common electrical circuit elements are inclusive of a piezoelectric circuit device. The piezoelectric circuit device is preferably inclusive of a housing defining a resonant cavity, a piezoelectric element bounding part of the cavity and electrical conductors for connection to the piezoelectric element.

The tag is further inclusive of noise-producing apparatus disposed in the tag and responsive to movement of the tag to cause the piezoelectric element to generate signals on the electrical conductors. The noise-producing apparatus is preferably disposed in the resonant cavity and the cavity supports the noise-producing apparatus for movement therein for effecting noise production. The noise-producing apparatus desirably comprises a spherical member supported for rolling movement in the resonant cavity.

The foregoing and other objects and features of the invention will be further understood from the following detailed description of preferred embodiments thereof and from the drawings wherein like reference numerals identify like components and parts throughout.

DESCRIPTION OF THE PREFERRED EMBODIMENTS AND PRACTICES

Figure 1:
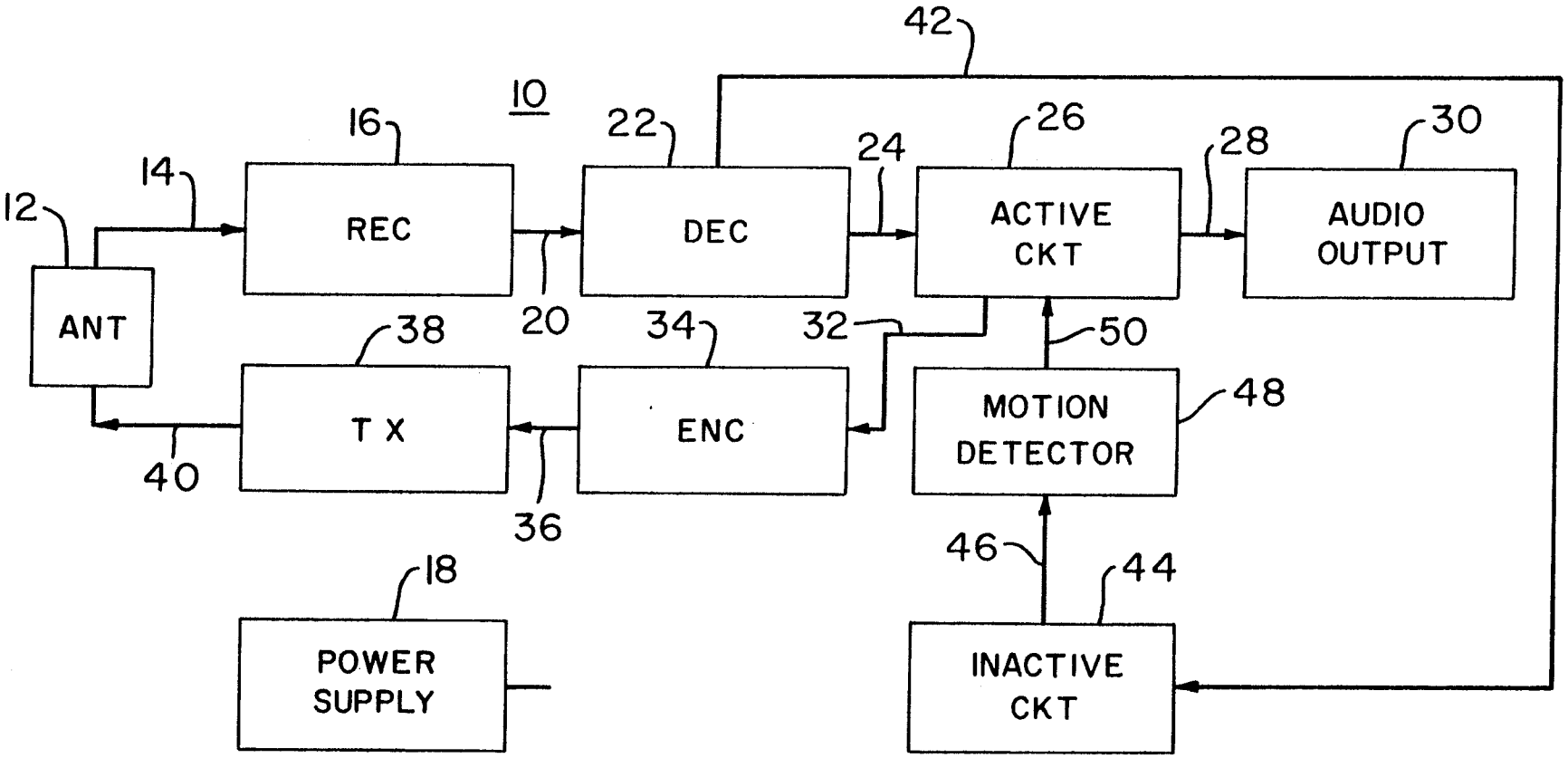
FIG. 1 (PRIOR ART)
FIG. 1 is a functional block diagram of the system of the tag of the '513 patent.

By way of introduction to the present invention, detailed discussion is had first of the tag of the incorporated '513 patent. Referring to FIG. 1, system 10 of the prior art tag includes antenna 12, output signals of which are conducted over line 14 to receiver 16. Receiver 16 and other circuitry of FIG. 1 are furnished with electrical power by power supply 18.

Receiver 16 provides its output over line 20 to decoder 22 which is operative to decode the message being sent to the tag. If the message is an active message, e.g., to arm the tag for readiness for detecting theft, the decoder supplies a signal over line 24 to active circuitry 26. On unauthorized transportation of the tag, such as through an exit of a store without being deactivated, circuitry 26 provides a signal over line 28 to activate audio output device 30. Active circuitry 26 is also operative to apply signals for transmission from the tag. Such signals are applied to line 32 and are encoded in encoder 34. The encoded signals are conveyed by line 36 to transmitter 38 and then over line 40 to antenna 12.

By way of example of the operation of tags of the '513 patent, in the course of checkout of tagged articles, a retailer of articles has an option of calling for "Audio" checkout or "Passive" checkout. If the Audio option is put in place, should a clerk fail to remove the tag from the article in the course of checkout, the tag remains in an armed state and, when it passes through the exit zone and receives the "Exit" message, the tag provides audio alarm output. A security guard can then issue a disarm message to the tag, assuming the article to have been properly checked out, whereupon the tag assumes a passive state in which its drain on its battery is minimized.

If the Passive option is elected by the retailer, the tag is placed in the passive state in the course of checkout and does not respond to the exit message transmission. Again, the tag energy consumption is minimized.

In general, tags of the '513 patent are in their passive states whenever they are not positively placed in active or armed states, with attendant energy savings, for example, when a retail facility is closed, e.g., overnight, when articles remain unmoved on shelves.

If the tag is placed in its passive state, decoder 22 activates line 42, so informing the tag inactive circuitry 44 which is then operative both to lessen the loading of power source 18 and, by a signal over line 46, to alert motion detector 48 to detect any tag movement. When movement is detected, the tag active circuitry returns to a fully powered condition.

Figure 2:
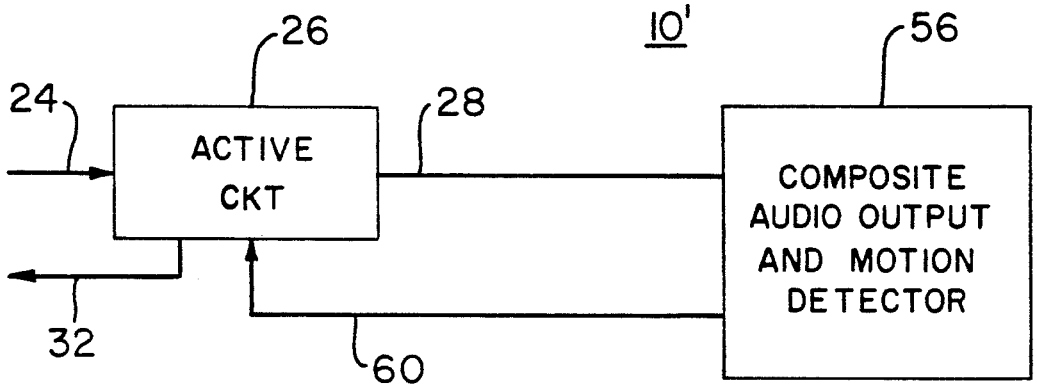
FIG. 2 is functional block diagram of the system of the tag of the subject invention as it departs from the tag system block diagram of FIG. 1.

Turning to FIG. 2, the partial block diagram therein will be seen to carryover from FIG. 1 the correspondingly numbered circuit elements and the tag 10' of the invention further would include all circuit elements of FIG. 1 leading to the generation or use of the signals on lines 24, 28 and 32. Line 28 is connected to composite audio output and motion detector 56. Unit 56 is further connected by line 60 to active circuitry 26.

When tag 10' is in its active condition, composite unit 56 receives the output of active circuitry 26 on line 28 and energizes the audio output of composite unit 56 as called for by the active circuitry. Conversely, when detection of tag motion is noted by composite unit 56, line 60 conveys signals to active tag circuitry 26 to awaken the tag, with full power supply loading being renewed.

Figure 4:
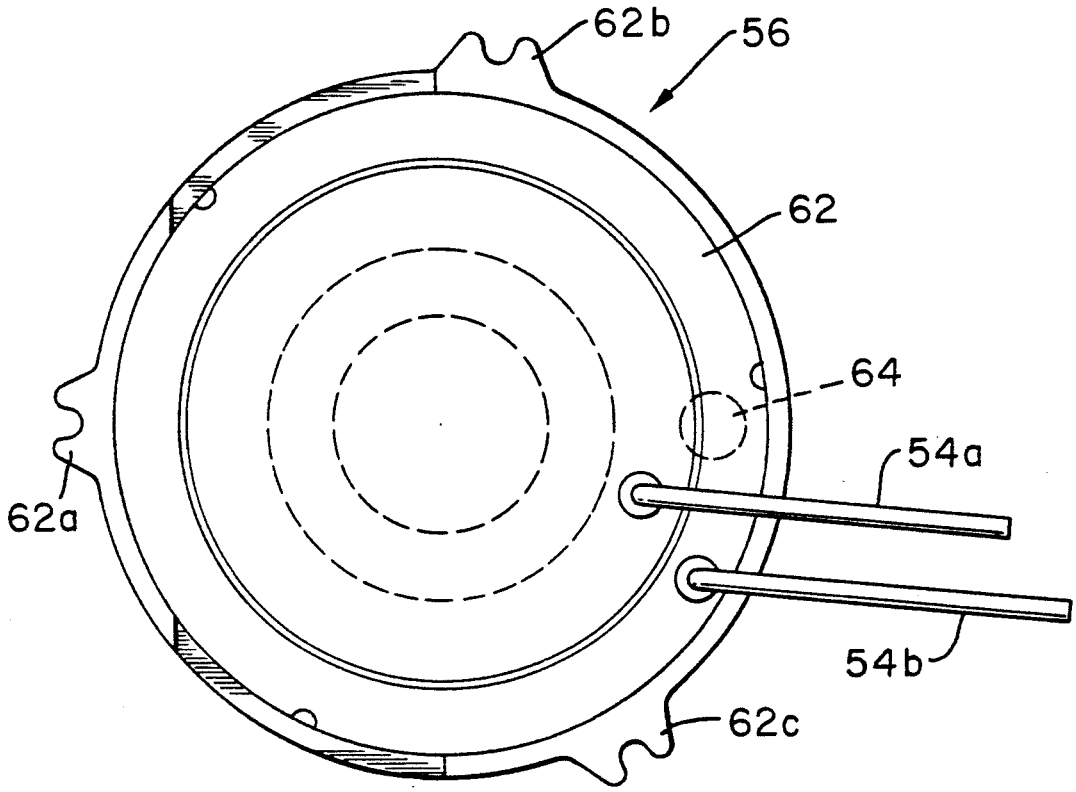
FIG. 4 is a plan view of the composite audio output and motion detector of FIG. 2.
Figure 3:
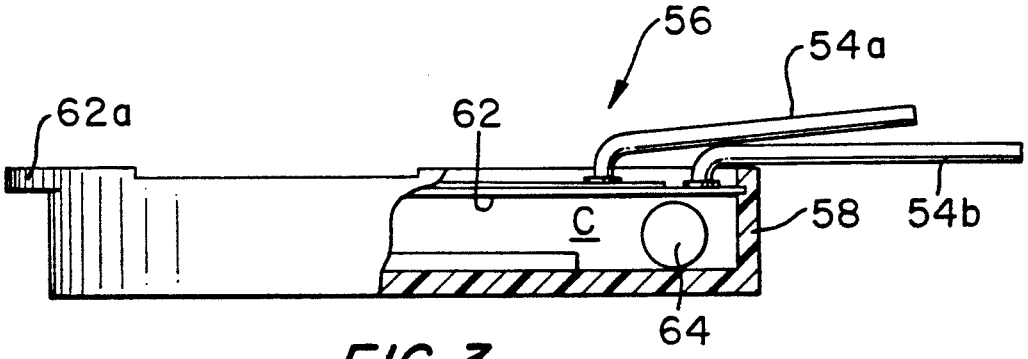
FIG. 3 is a front elevation, partly in section, of the composite audio output and motion detector of FIG. 2.

Composite unit 56 is shown in its preferred form in FIGS. 3 and 4, to which reference is now made. The prior art tags above considered incorporated a piezoelectric audio unit as their audio output devices, i.e., unit 30 of FIG. 1. The subject invention introduces a modification in such unit, thereby permitting a composite audio output and motion detector. The composite unit has an electrically insulative housing 58 defining a resonant cavity C therein. A piezoelectric element in the form of disc 62 bounds cavity C at its upper side, disc 62 being provided with mounting ears or lugs 62*a*, 62*b* and 62*c*. Individual electrical conductors 54*a* and 54*b* extend from disc 62 as indicated, being electrically connected therewith.

In the systems of the prior art tags, conductors 54*a* and 54*b* applied electrical energy to the piezoelectric element, giving rise to sinusoidal displacement thereof at resonance and corresponding audible output. That function carries over to tags in accordance with the present invention, i.e., when line 28 provides signals to composite unit 56 in the FIG. 2 embodiment.

Further, per the subject invention, a movable, preferably rollable, member 64 is disposed in cavity C and movement thereof within the cavity noise-stresses the piezoelectric element, whereupon it generates output electrical signals on conductors 54*a* and 54*b*. One of the conductors is connected to circuit ground and the other is used to convey the signals to user circuitry. As will be appreciated, the signal conveying one of conductors 54*a* and 54*b* constitutes both of lines 28 and 60, the former when conveying signals to unit 56 to cause audio output thereby, and the latter when conveying signals indicative of tag movement to active circuitry 26.

Figure 5:
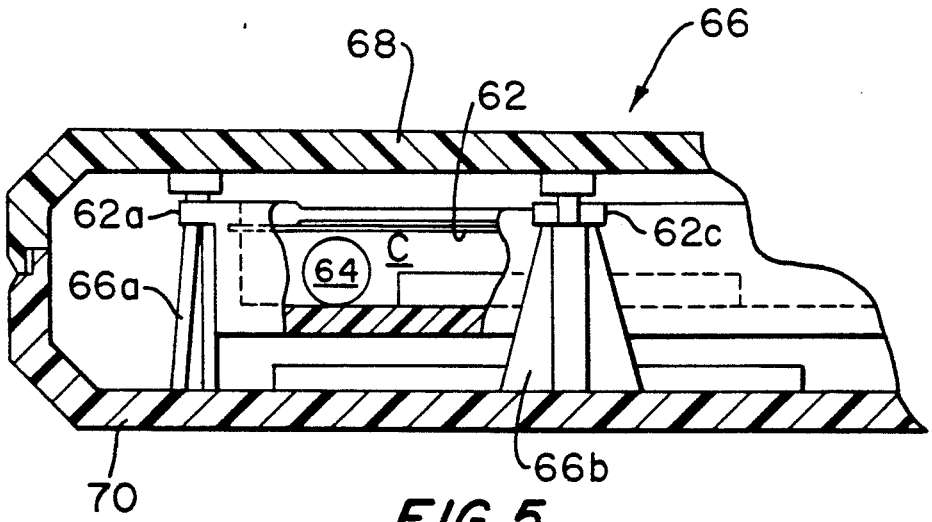
FIG. 5 is a partial sectional view of a tag constructed in accordance with the invention.

A tag device 66 is shown in FIG. 5, broken away in various parts to illustrate the placement and mounting of the composite unit. As shown, the tag device has upper and lower plastic housings 68 and 70, which are secured together. Mounting posts extend between housings 68 and 70 and receive the piezoelectric element mounting ears to support the composite unit in the tag device, two such mounting posts, 66*a* and 66*b*, being seen in FIG. 5.

Figure 6:
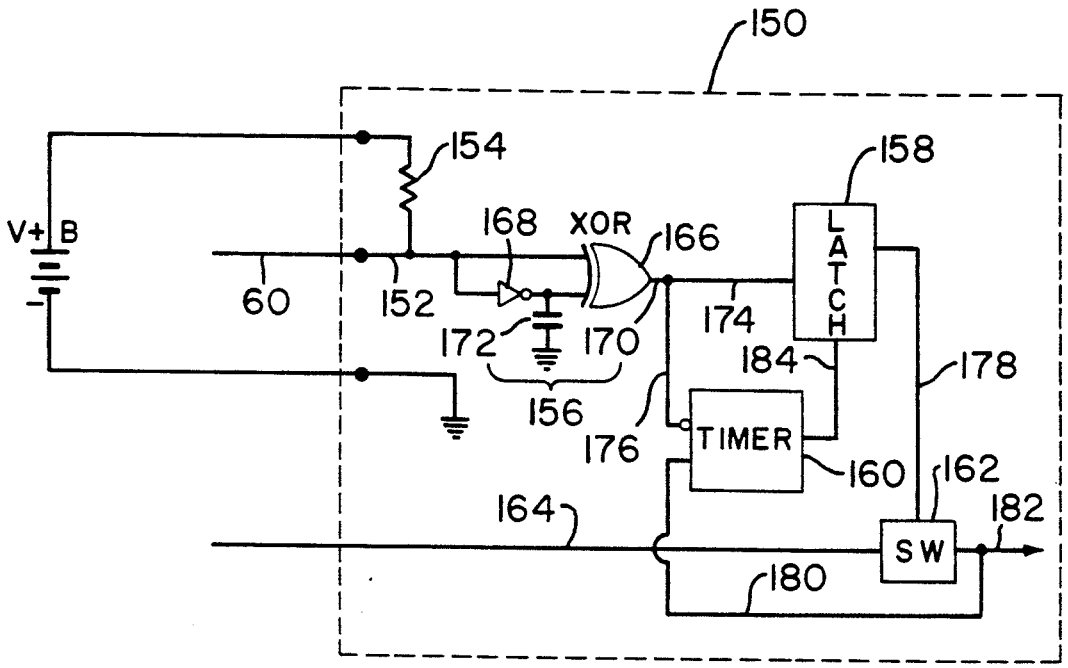
FIG. 6 is block diagram of a system usable with the subject motion detector.
Figure 7:
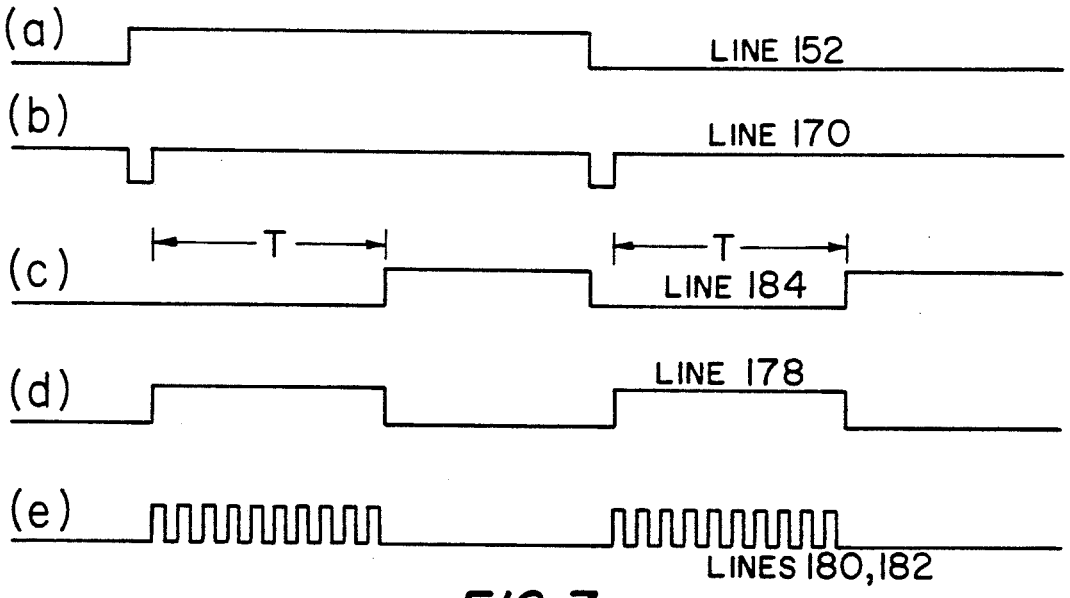
FIG. 7(*a*)–7(*e*) is a timing diagram explanatory of the FIG. 6 system.

Turning to FIGS. 6 and 7, system 150 is included in active circuitry 26 of FIG. 2 and is used to detect the movement Of the electrically conductive element by looking to line 60 (conductors 54*a* and 54*b*) and electrical potential variation thereon. When the piezoelectric element 62 is not sensing noise generation, line 60 is at ground potential as is input line 152. Resistor 154 interconnects input line 152 to the battery positive terminal and its resistance value is very large so that the current through the resistor is minimized when line 152 is at ground potential.

When the motion sensor is at rest, input line 152 will be at a constant ground voltage level. When there is movement, the noise-generating element (single sphere and housing end walls or plural spheres) will be in random motion, sometimes making contact and sometimes separated. This will cause line 152 to toggle between positive and negative voltage levels and ground. The system includes for motion detection a transition detector 156, a latch 158, a timer 160 and an analog switch 162. The system is furnished With clock pulses over line 164 from a suitable clock pulse generator (not shown).

Transition detector 156 is operative to sense a change in voltage level on input line 152, either from ground to a voltage level or from a voltage level to ground. When there is no motion, the inputs to exclusive OR (XOR) gate 166 will be at opposite logic levels. If the upper input is high (logic 1), the lower input will be low (logic 0) and vice versa, since the lower input is connected to the upper input by an inverter 168. The following truth table applies.

| STATE | UPPER INPUT | LOWER INPUT | OUTPUT |
|---|---|---|---|
| 1 | 0 | 0 | 0 |
| 2 | 0 | 1 | 1 |
| 3 | 1 | 0 | 1 |
| 4 | 1 | 1 | 0 |

From the table, it can be seen that both states 2 and 3 will cause the detector 156 output to be high. When line 152 changes voltage level, the inputs to gate 166 will be at the same logic level for a short period of time (states 1 or 4). While the inputs are in this state, the output of detector 156 will go low. This creates a pulse on output line 170 of the detector on both positive and negative transitions of line 152. The pulse width is determined by the propagation delay of the inverter and the charge time of capacitor 172. The timing of this pulse is shown in FIG. 7, part (a).

The detector 156 output is applied over lines 174 and 176 respectively to latch 158 and timer 160. When the detector output goes low, as is seen in part (b) of FIG. 7, it resets the timer, causing the output of the timer on line 184 to go low for a preselected time period T, as is shown in part (c) of FIG. 7. The detector output also provides a clock signal on line 174 for latch 158. On the positive edge of the pulse, the output of the latch will go high, as is seen in part (d) of FIG. 7. The output of the latch provides a control signal on line 178 for analog switch (SW) 162. When the latch 158 output goes high, analog switch 162 is enabled. This event passes the clock input on line 164 through the switch to the timer over line 180 and to other circuitry (not shown) over line 182. This event is seen in part (e) of FIG. 7.

Once the clock input is applied to the timer, the timer begins to count. If another pulse is thereafter generated by transition detector 156, the timer will be reset and will restart its count, as is the case in the showing of FIG. 7. If there is no motion for the time period set, the timer will overflow, causing the output of the timer to go high. This resets the latch and causes the output of the latch to go low. Once the output of the latch goes low, the analog switch is disabled and this event disconnects the clock input from the timer and such other circuitry. Such other circuitry, which is connected to battery B, would fulfill the function of the apparatus on which the motion sensor and detection system are disposed. Where the other circuitry is CMOS, its current consumption is directly proportional to the clock frequency on line 182. By disabling the clock, there is substantially reduced battery loading. A substantially greater life expectancy is thus afforded.

Evidently, where there is the condition of continuing resetting of the timer, motion being sustained, the battery is loaded by the other circuitry and the apparatus associated with the motion sensor is thereby fully operative.

Various changes to structure and practice may be introduced in the foregoing embodiments and methods without departing from the invention. Thus, the particularly discussed and depicted embodiments and methodology are intended in an illustrative and not in a limiting sense. The true spirit and scope of the invention is set forth in the following claims.

What is claimed is:

1. In an electronic article surveillance tag of the type comprising an electrical power source, receiver means for receiving coded messages for diverse state disposition of said tag, decoder means for decoding received coded messages and for directing said tag into active and inactive states, alarm means for providing audible output indication of unauthorized activity in respect of said tag in an active state thereof, and motion detector means operative upon disposition of said tag in an inactive state for lessening drain on said electrical power source and further operative on movement of said tag when in said inactive state to dispose said tag in an active state with increased drain on said electrical power source, the improvement wherein said alarm means and said motion detector means are constituted of common electrical circuitry comprising piezoelectric circuit means inclusive of housing means defining a resonant cavity, a piezoelectric element providing a boundary of said cavity and electrical conductor means for connection to said piezoelectric element, said common electrical circuitry being responsive to input signals for providing audible output indication of unauthorized activity in respect of said tag in said active state thereof and generating output signals indicative of said movement of said tag when in said inactive state.

2. The invention claimed in claim 1 wherein said tag is further inclusive of noise-producing means disposed in said tag and responsive to movement of said tag to cause said piezoelectric element to generate signals on said electrical conductor means.

3. The invention claimed in claim 2 wherein said noise-producing means is disposed in said resonant cavity.

4. The invention claimed in claim 3 wherein said resonant cavity supports said noise-producing means for movement therein for effecting such noise production.

5. The invention claimed in claim 4 wherein said noise-producing means comprises a spherical member supported for rolling movement in said resonant cavity.

6. In combination:

(a) an electrical article surveillance tag inclusive of an electrical power source contained with said tag and circuitry powered by said electrical power source; and (b) a motion detector operatively associated with said tag and contained therewith, said motion sensor being connected electrically with such tag circuitry, said motion sensor comprising piezoelectric means adapted on detecting tag movement for selectively effecting increased electrical loading of said electrical power source by said tag circuitry, said tag further includes alarm means for generating audible output, said alarm means and said motion detector sharing common electrical circuitry, said common electrical circuitry being inclusive of said piezoelectric means, said piezoelectric circuit means comprising housing means defining a resonant cavity, a piezoelectric element providing a boundary of said cavity and electrical conductor means for connection to said piezoelectric element.

7. The invention claimed in claim 6 wherein said tag is further inclusive of noise-producing means disposed in said tag and responsive to movement of said tag to cause said piezoelectric element to generate signals on said electrical conductor means.

8. The invention claimed in claim 7 wherein said noise-producing means is disposed in said resonant cavity.

9. The invention claimed in claim 8 wherein said resonant cavity supports said noise-producing means for movement therein for effecting such noise production.

10. The invention claimed in claim 9 wherein said noise-producing means comprises a spherical member supported for rolling movement in said resonant cavity.

11. In combination, in an electrical apparatus:

(a) an electrical power source and circuitry powered by said electrical power source;

(b) a motion detector comprising piezoelectric means adapted on detecting movement of said apparatus for selectively effecting increased electrical loading of said electrical power source by said apparatus circuitry; and (c) alarm means for generating audible output, said alarm means and said motion detector sharing common electrical circuitry inclusive of said piezoelectric means comprising housing means defining a resonant cavity, a piezoelectric element providing a boundary of said cavity and electrical conductor means for connection to said piezoelectric element, said common electrical circuitry being responsive to input signals for generating said audible output and providing output signals for selectively effecting said increased electrical loading of said electrical power source by said apparatus circuitry.

12. The invention claimed in claim 11 wherein said apparatus is further inclusive of noise-producing means disposed in said apparatus and responsive to movement of said apparatus to cause said piezoelectric element to generate signals on said electrical conductor means.

13. The invention claims in claim 12 wherein said noise-producing means is disposed in said resonant cavity.

14. The invention claimed in claim 13 wherein said resonant cavity supports said noise-producing means for movement therein for effecting such noise production.

15. The invention claimed in claim 14 wherein said noise-producing means comprises a spherical member supported for rolling movement in said resonant cavity.

* * * * *